United States Patent [19]

Masson

[11] Patent Number: 4,657,149

[45] Date of Patent: Apr. 14, 1987

[54] FOLDABLE DISPLAY ASSEMBLY

[75] Inventor: Paul J. Masson, Cincinnati, Ohio

[73] Assignee: Lingo Manufacturing Company, Florence, Ky.

[21] Appl. No.: 783,844

[22] Filed: Oct. 3, 1985

[51] Int. Cl.[4] ..... A47B 47/00

[52] U.S. Cl. ..... 211/194; 211/195; 211/198; 211/189; 52/70; 160/135; 312/140.2; 40/610

[58] Field of Search ..... 211/195, 194, 169, 198, 211/175; 160/135, 351; 40/610, 605, 539; 52/79.5, 71, 70, 36; 312/140.2, 210; 108/60

[56] References Cited

U.S. PATENT DOCUMENTS

| | | | |
|---|---|---|---|
| 3,113,392 | 12/1963 | Downing | 211/195 |
| 3,319,801 | 5/1967 | Nordstrom | 160/135 |
| 3,958,786 | 5/1976 | Mann | 211/195 |
| 4,043,086 | 8/1977 | Kaulfuss et al. | 52/71 |
| 4,194,313 | 3/1980 | Downing | 40/605 |
| 4,319,688 | 3/1982 | Wahl | 211/175 |
| 4,416,093 | 11/1983 | Salkeld et al. | 52/71 |
| 4,428,136 | 1/1984 | Franklin | 211/175 |
| 4,467,854 | 8/1984 | Godfrey | 160/135 |
| 4,561,550 | 12/1985 | Franklin | 211/189 |
| 4,583,311 | 4/1986 | Hosey et al. | 40/605 |

*Primary Examiner*—Richard J. Scanlan, Jr.
*Assistant Examiner*—Anthony Knight
*Attorney, Agent, or Firm*—Frost & Jacobs

[57] ABSTRACT

A display assembly of the type having a rear display panel angularly joined by lateral display panels includes foldable end sections which allow the display assembly to become relatively flat when disassembled. The relatively flat folded assembly may then be packed into a relatively small container for more cost-effective shipping.

9 Claims, 5 Drawing Figures

FOLDABLE DISPLAY ASSEMBLY

TECHNICAL FIELD

The invention relates generally to display assemblies and more particularly to bay type display assemblies having a rear display section joined on opposite sides by a pair of angularly arranged lateral display sections. The invention will be specifically disclosed in connection with a PEGBOARD type display assembly for hanging items of merchandise from rods supported upon PEGBOARD display panels.

BACKGROUND OF THE INVENTION

It is a common merchandising practice to display small items of merchandise by hanging the items on rod-like hangers which are supported on a PEGBOARD panel. Such displayed items are commonly "carded", that is, mounted upon a paperboard card, and are frequently secured to the cards by clear plastic shrink wrapping. Each of the paperboard cards has an aperture for receiving one of the rod-like hangers. The PEGBOARD panels generally support a plurality of hangers and each of the hangers, in turn, commonly support a plurality of the packaged or carded items.

In some instances, the PEGBOARD display panel used for supporting the hangers may be attached to a permanent structure, such as a wall or a shelf. Alternatively, it may be desirable to occasionally move the display from one place to another, and, therefore the PEGBOARD may be attached to a movable frame. In order to avoid the impression that a movable display is temporary and that the goods displayed therefrom are of inferior quality, considerable efforts have been made toward designing displays which have a permanent appearance and which are aesthetically attractive. One popular display design includes a first rear display section joined on opposite sides by a pair of end sections of generally triangular cross-sectional configuration. In this design, the outside portions of the side panels join the rear panel in generally perpendicular relationship, while the inside portions form display surfaces and are angularly joined to the rear display panel. A design of this general type is disclosed in U.S. Pat. No. 4,319,688 to Wahl.

It is frequently necessary to ship display assemblies of this type to retail stores in small quantities. However, due to the triangular configuration of the end sections, these assemblies do not fit compactly into containers which can be economically shipped by commercial carriers, even when the assemblies are disassembled. Moreover, some transporters will not ship packages which exceed certain prescribed dimensions, for example, packages which have a combined length and girth dimension exceeding 108 inches. Consequently, if the dimensions of the package containing the display assembly exceed the prescribed length and girth limitations, other and more costly shipping arrangements must be made.

SUMMARY OF THE INVENTION

Accordingly, it is an object of the invention to provide a display assembly which may be disassembled and economically shipped.

It is another object of the present invention to provide a display assembly which will, when disassembled, fit compactly into a relatively small shipping container.

Another object of the invention is to provide a display assembly having end sections of triangular configuration which will fold into a relatively flat shipping position.

A still further object of the invention is to provide a modular display assembly.

To achieve the foregoing and other objects, in accordance with the purposes of the present invention as described herein, an improved display assembly is provided which is foldable for shipment. The assembly includes a rear display section having a pair of lateral supports releasably securable to each side thereof. Each lateral support includes an elongated slot. An angular display section is associated with each lateral support. Each of the angular display sections includes inside and outside edges. The inside edge of each angular display section is pivotally interconnected to its associated lateral support. A side section is associated with each angular display section, each of which also has an inboard and outboard edge. The inboard edge of each side section is pivotally interconnected to the lateral support to which its associated display section is pivotally interconnected. The outboard edge of each side section is pivotally connected to the outside edge of its associated angular display section. The pivotal connection between the lateral support and either the angular display sections or the side sections is about a pin slidable within the elongated slot. This construction allows the pivotally interconnected display and side sections to fold into substantially parallel relationship with the lateral support.

According to a specific aspect of the invention, the inside edge of each side section is pivotally interconnected to its associated lateral support about a pin slidable within the elongated slot. The inside edge of each angular display section is pivotally interconnected to its associated lateral support about a pivotal axis which is fixed relative to the lateral support.

In accordance with one principal aspect of the invention, the side sections are movable between a first assembled position and a second shipping position. The first assembled position is generally perpendicular to the lateral supports and the second shipping position is generally parallel to the lateral supports.

The lateral supports preferably include a pair of vertically aligned horizontally extending elongated structural members joined by a vertical support. The slot in which the pivotal pin is slidable is formed in each of these structural members.

According to another specific aspect of the invention, the side sections include vertically upper and lower horizontally extending support members. A substantially planar panel is preferably secured to such support members.

The angular display section may also include upper and lower elongated structural members for supporting a PEGBOARD.

In still another aspect of the invention, the assembly includes upper and lower subassemblies which may be independently packaged for shipment. The upper and lower subassemblies are joined by interposed junction plates and are secured together by fasteners.

Still other objects of the present invention will become apparent to thoe skilled in this art from the following description wherein there is shown and described a preferred embodiment of the present invention, simply by way of illustration, of one of the best modes contemplated for carrying out the invention. As will be realized, the invention is capable of other different embodiments, and its several details are capable of modification in various, obvious aspects without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and, together with the description, serve to explain the principles of the invention. In the drawings.

Reference will now be made in detail to the present preferred embodiment of the invention, an example which is illustrated in the accompanying drawings.

DETAILED DESCRIPTION OF THE PREFERRED EMBODIMENT

Figure 1:
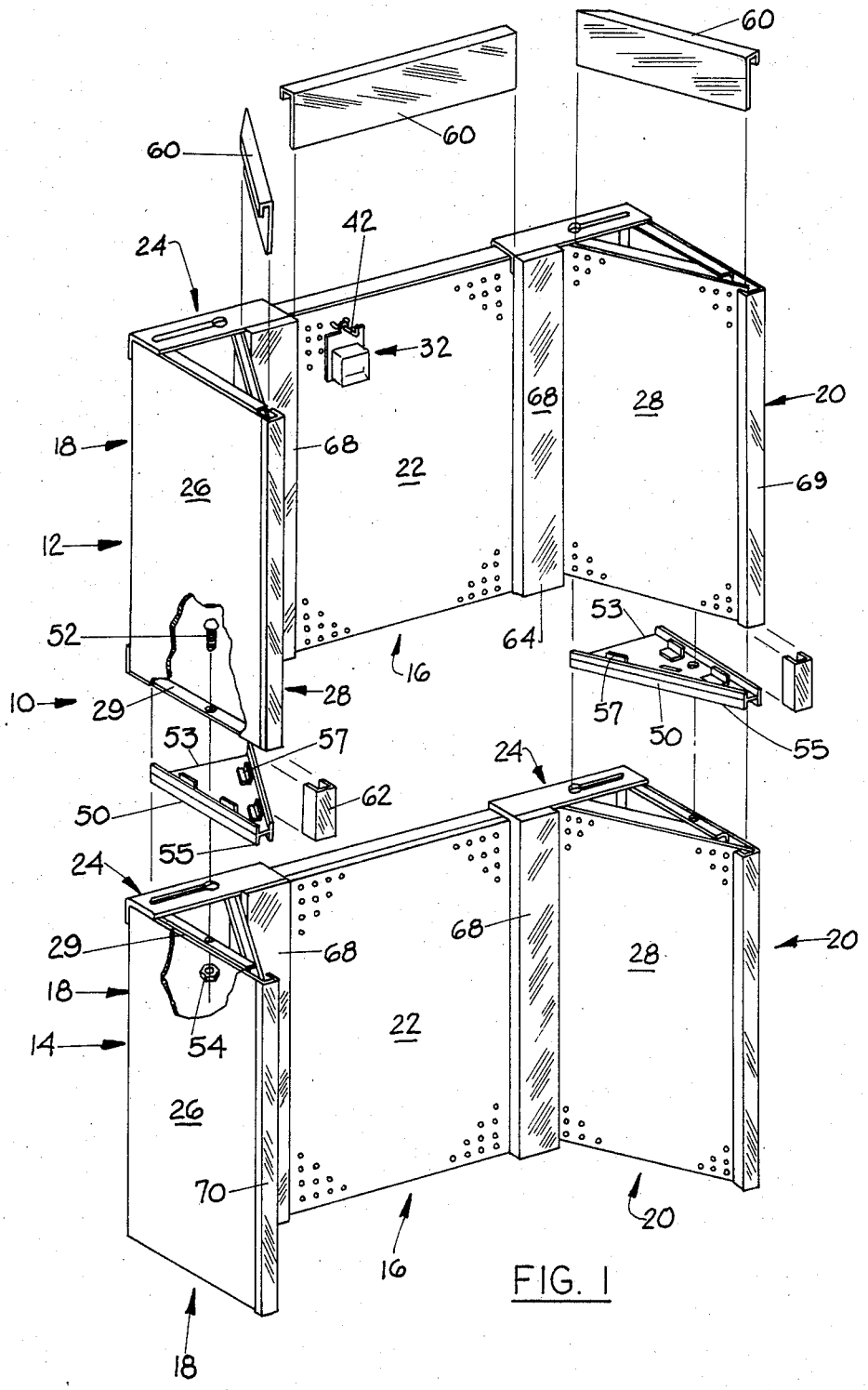
FIG. 1 is an exploded isometric view of one embodiment of the invention.

Referring now to the drawings, FIG. 1 depicts a display assembly constructed in accordance with the principles of the present invention, which display assembly is generally designated by the numeral 10. The illustrated assembly 10 includes an upper subassembly portion 12 supported upon a lower subassembly portion 14. The upper and lower subassembly portions 12,14 are identical and, for purposes of brevity, only the upper portion 12 will be described in detail, with identical numbers being applied to corresponding components of the lower subassembly 14. As will also be apparent from the description that follows, and from viewing FIG. 2, either of the FIG. 1 subassemblies 12,14 may be independently used as a display assembly.

The upper subassembly 12 is formed of three major sections, a rear display section 16 and two end sections 18 and 20 positioned on opposite sides of the rear display section 16. The rear display section 16 includes a first display panel 22 formed of PEGBOARD material.

As shown in FIG. 1, the end sections 18 and 20 each have triangular cross-sectional configurations in their assembled positions. Each of the triangularly configured end sections is, in turn, comprised of three sections, a lateral support section 24, a side section 26, and an angular display section 28. Although the bottom portions of end sections 18 and 20 are not specifically illustrated in FIG. 1, it will be appreciated that these sections 18 and 20 are mirror images of each other, and that the same modular unit 16 or 18 may be used for either section by simply inverting the unit (turning it upside down). In the assembled position, the side section 26 forms a plane which is generally perpendicular to the plane formed by the lateral support 24. The angular display section 28 forms a plane obliquely oriented with respect to both the side section 26 and the lateral support section 24.

Figure 2:
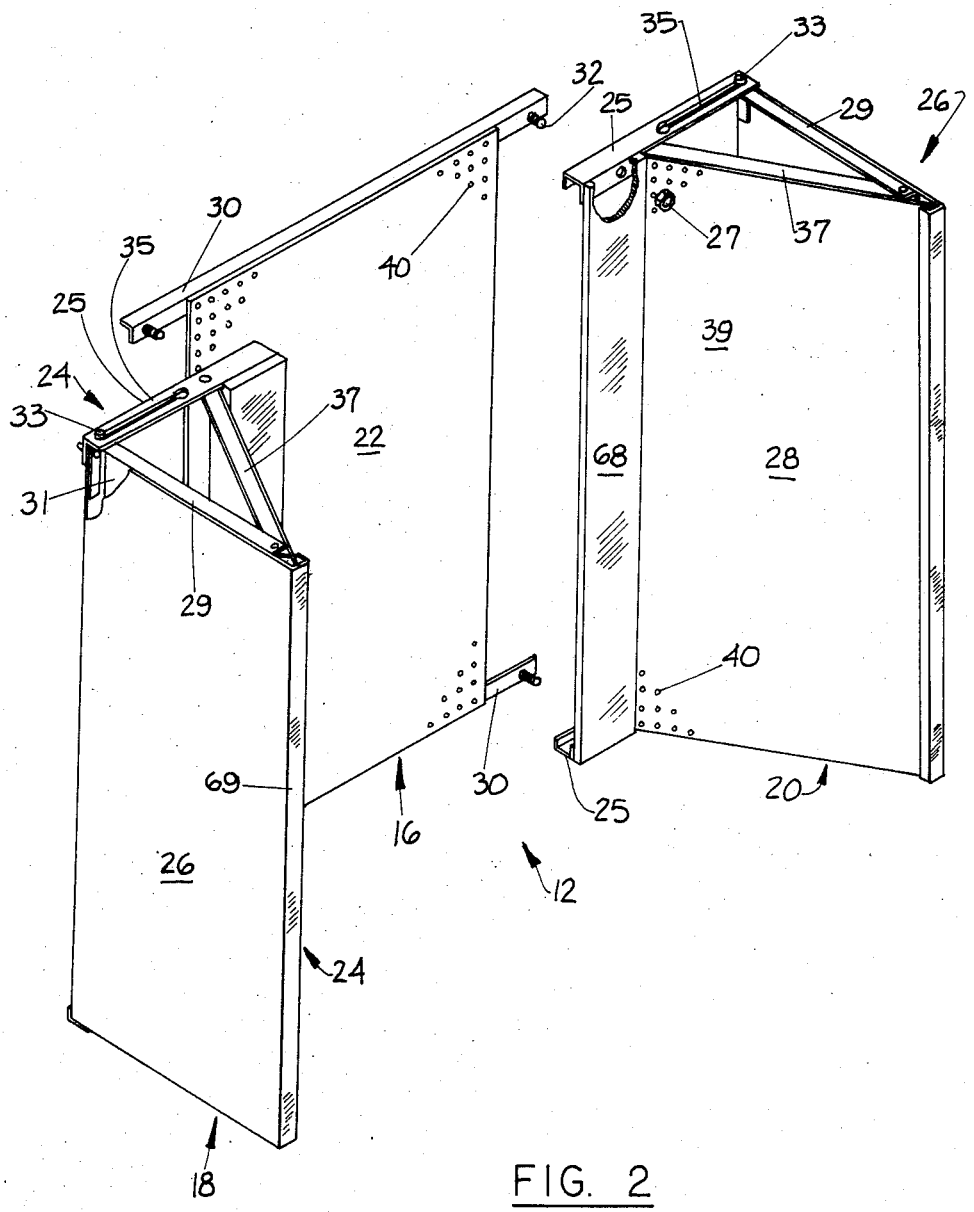
FIG. 2 is a perspective view of the lower section of the display assembly of FIG. 1 depicting disassembled rear and end sections of the assembly.

Turning now to FIG. 2, it is seen that the display panel 22 is substantially planar and is supported by a pair of horizontally extending elongated structural support members 30, specifically illustrated as lengths of angle iron.

Figure 5:
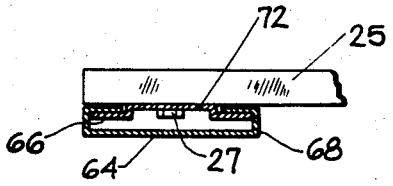
FIG. 5 is a cross-sectional view through the strip and corresponding support.

Each of the lateral support sections 24 include upper and lower elongated structural members 25 extending outwardly from the sides of the rear display section 16. As illustrated, these structural members 25 are also formed of angle iron and are joined by a vertically extending support member 72 (not shown in FIGS. 1 and 2, see FIG. 5). Bolts 32 extend through the angle iron suports 30 and the structural members 25 and support member 72 to releasably secure the lateral support sections 24 relative to the rear display section 16. These bolts 32 are each received by a nut 27. The lateral support sections 24 extend generally parallel to the rear display panel 22.

The side sections 26 each include upper and lower horizontally extending elongated support members 29, also shown as being formed from angle iron in the illustrated embodiment, which support members 29 support a substantially planar side panel 31. The angle iron support members 29 are supported at the upper and lower extremities of their inboard edges by a pair of coaxially aligned pins 33. The pins 33 are disposed within an elongated slot 35 formed in each of the elongated structural support members 25. In the assembled position, the side panel 31 extends generally perpendicular to the rear display panel 22.

In a similar manner, the display sections 28 each include upper and lower elongated support members 37 which support a substantially planar panels 39. The panels 39 are PEGBOARD and angularly positioned with respect to the first or rear display panel 22. As illustrated, the panels 39 form second and third display panels which divergingly extend forward from and are obliquely oriented with respect to the first display panel 22.

It will be appreciated by those skilled in the art that the PEGBOARD panels 22 and 39 each contain a plurality of uniformly spaced apertures 40, which apertures 40 are designed for receiving the prongs of a plurality of rod-like hangers 42 (see FIG. 1) supported on the PEGBOARD panels 22 and 39. The hangers 42 are, in turn, used to support merchandise items. In FIG. 1, one such merchandise item 32 is shown. The illustrated item is secured to a paperboard card and is shown hanging from the hanger 42. In actual use it is likely that each of the PEGBOARD panels 22,39 will contain a plurality of hangers 42, and that each of the hangers 42 will support a plurality of merchandise items 32.

Figure 3:
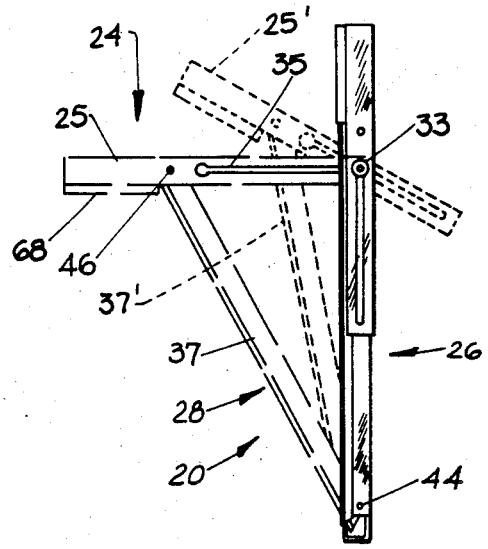
FIG. 3 is a plan view of one of the end sections of the display assembly of FIG. 2.

In accordance with one of the principal aspects of the invention, the end sections 18 and 20 may, when disassembled, be folded into relatively flat configurations for shipping purposes. The manner in which the illustrated end sections 18,20 are folded is most readily realized from viewing FIG. 3.

As previously noted, the inboard end of end section 26 is pivotally interconnected to the lateral support section 24 by a pair of coaxially aligned pins 33, which pins 33 are slidingly movable within the slot 35 of the horizontally extending structural members 25. The outboard edge of the end section 26 is also pivotally interconnected to the outside edge of the angular display 28 about a fixed rivet hinge 44. Furthermore, the inside edge of angular display section 28 is pivotally connected to the structural member 25 about a fixed rivet hinge 46. This structural arrangement permits the lateral support section 24 to move from the assembled position illustrated in the first phantom line position shown in FIG. 3 (identified by the numerals 25 and 37) to an intermediate position illustrated in the second phantom line position (identified by the numerals 25' and 37'). As will be readily apparent, continued movement in this direction brings the end section 20 to the relatively flat arrangement shown in the solid line depiction of FIG. 3.

Figure 4:
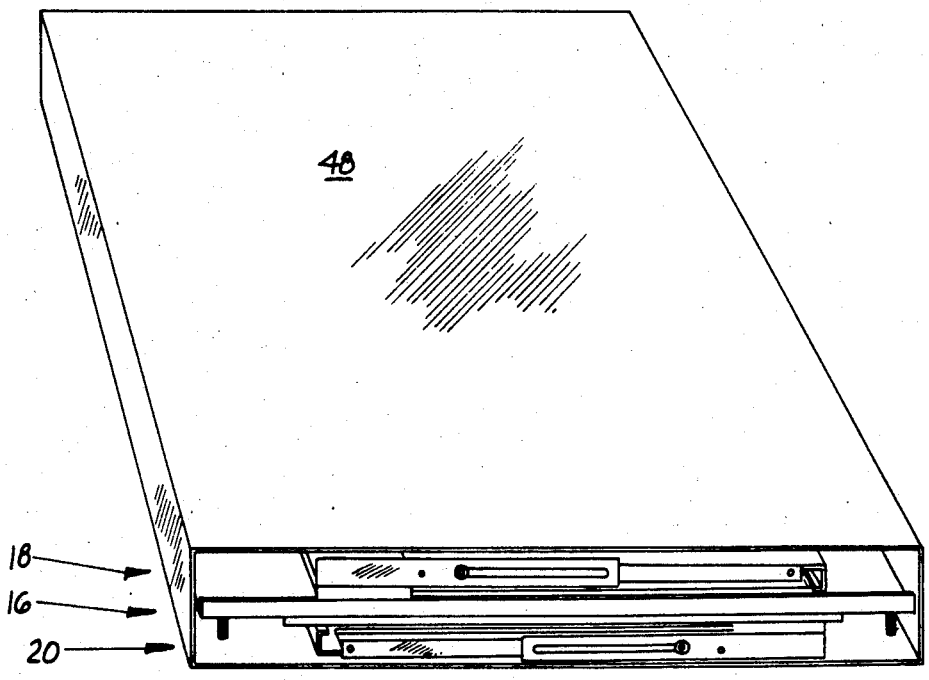
FIG. 4 is an isometric view of the display assembly of FIG. 1 as it is disassembled and placed in a shipping container.

The advantages of folding the end section 20 in this manner are demonstrated in FIG. 4 where the entire subassembly 12 is shown as fitted into a relatively flat shipping container 48. For example, a subassembly 12 constructed in accordance with the preferred embodiment with a 36" by 30" rear display section and two 36" by 15" display panels may be fitted into a box having the dimensions 37"×31"×4". As those familiar with shipping will readily appreciate, a container 48 having such dimensions falls within the prescribed maximum 108" length plus girth dimension of many commercial shippers.

Returning once again to FIG. 1, it will be apparent that an assembly having a height of 72" may be readily formed by combining two 36" tall subassemblies in the manner depicted in FIG. 1. Furthermore, it will be readily apparent that each of the 36" tall subassemblies may be shipped in containers dimensioned within the maximum 108" length and girth limitations.

FIG. 1 further shows how the subassemblies 12 and 14 may be quickly and readily assembled. Once the assembly of the subassemblies 12,14 is completed, a junction plate 50 is placed over each of the lower end sections 18,20. The junction plates 50 are formed of horizontally oriented plates 53 of triangular configuration. Retainer strips 55 extending above and below the plate 53 are secured to two of the three triangular plate sides. A plurality of spacer tabs 57 are also secured on both the upper and underside surfaces of the plate in spaced relationship with the retainer strips 55 so as to form channels therebetween. These channels are dismensioned to receive the structural members 29 and 37, the channels on the underside of the plate receiving the structural members of the lower subassembly 14 and the channels on the upperside of the plate receiving the structural members of the upper subassembly 12. In addition, a bolt 52 extends through the adjacent structural members 29 (of subassemblies 12 and 14) and the plate 53 and is received by a nut 54 for securing the upper and lower subassemblies 12,14. However, bolt 52 and corresponding nut 54 are not necessary, in that the channels formed by spacer tabs 57 and retainer strips 55 receive the structural members 29 and 37 by friction fit.

As suggested in FIG. 1, it is also desirable to place chrome header trim strips 60 over the top edges of each of the display panels. For the same reason, a chrome cover 62 is placed at the junction of the subassemblies 12 and 14. As most clearly seen in FIG. 5, the vertical support 72 joining the upper and lower structural members 25 of the lateral supports 24, includes outwardly extending flanges 66, and these flanges 66 may be used to support a chrome strip 68 between the rear and angular display surfaces. Optionally, chrome strip 68 may be permanently mounted on the upper and lower structural members 25, thereby eliminating the need for vertical support 72. A chrome strip 70 is also preferably used to cover the outside edge 69 of the angular display side section 26. The chrome strip 70 is an elongated U-shaped strip which friction fits over the outside edge 69.

In summary, numerous benefits have been described which result from employing the concepts of the invention. The display assembly is foldable when disassembled, and may be contained within a relatively small package for economical shipping. The assembly is also modular and can be constructed from two basic components, a rear display section 16 and two end sections 18 or 20. Although two different end sections 18 and 20 are used, the different end sections are mirror images of each other, and one type of end section 18 may be converted to the other type 20 by mere inversion (or turning end section 18 upside down to form end section 20).

The foregoing description of a preferred embodiment of the invention has been presented for purposes of illustration and description. It is not intended to be exhaustive or to limit the invention to the precise form disclosed. Obvious modifications or variations are possible in light of the above teachings. For example, instead of making the pivotal interconnection between the side section 26 and lateral support 24 slidable as in the illustrated embodiment, that interconnection could be about a fixed axis and the angular display side section 26 could be secured to the lateral support 24 about a movable pivotal axis. The embodiment was chosen and described in order to best illustrate the principles of the invention and its practical application to thereby enable one of ordinary skill in the art to best utilize the invention in various embodiments and with various modifications as are best suited to the particular use contemplated. It is intended that the scope of the invention be defined by the claims appended hereto.

What is claimed is:

1. A display assembly which is foldable for shipment, comprising:

(a) a rear display section;

(b) a pair of lateral supports, one of said lateral supports being releasably securable to each side of the rear display section, each lateral support including elongated slot means;

(c) an angular display section associated with each lateral support, each of said angular display sections including inside and outside edges with the inside edge of each angular display section being pivotally interconnected to its associated lateral support; and (d) a side section associated with each angular display section, each of said side sections having inboard and outboard edges, the inboard edge of each side section being pivotally interconnected to the same lateral support to which its associated display section is pivotally interconnected, with the outboard edge of each side section being pivotally interconnected to the outside edge of its associated angular display section, the pivotal interconnection between the lateral support and one of the angular display sections and side sections being about a pin slidable within the elongated slot means so as to allow the pivotally interconnected display and side sections to fold into substantially parallel relationship with the lateral support.

2. A display assembly as recited in claim 1 wherein the inboard edge of each of the side sections is pivotally iterconnected to its associated lateral support about a pin slidable within the elongated slot means, the inside edge of each of the angular display sections being pivotally interconnected to the associated lateral support about a pivotal axis which is fixed relative to its associated lateral support.

3. A display assembly as recited in claim 2 wherein said side sections are movable between a first assembled position, generally perpendicular to the lateral supports, and a second shipping position generally parallel to the lateral supports.

4. A display assembly as recited in claim 3 wherein each of said lateral supports includes a pair of vertically aligned horizontally extending elongated structural members joined by a vertical support, said slot means including an elongated slot in each of the elongated structural members.

5. A display assembly as recited in claim 3 wherein said side sections include vertically aligned upper and lower horizontally extending elongated support members supporting a substantially planar panel.

6. A display assembly as recited in claim 3 wherein each of said angular display sections includes upper and lower vertically aligned horizontally extending elongated structural members supporting a substantially planar PEGBOARD.

7. A display assembly as recited in claim 6 wherein said rear display section includes a plurality of elongated structural support members supporting a substantially planar PEGBOARD.

8. A display assembly as recited in claim 5 wherein the elongated structural members of the rear display section extend substantially horizontally, and the rear section PEGBOARD is secured to the substantially horizontal structure members proximal to its upper and lower edges.

9. A display assembly as recited in claim 3 wherein each of the angular display sections is obliquely oriented with respect to both the display and side sections.

* * * * *